United States Patent [19]

Goodworth, II

[11] Patent Number: 4,640,064

[45] Date of Patent: Feb. 3, 1987

[54] SUSPENSION CEILING SYSTEM COMBINING SNAP-UP PANS AND LAY-IN PANELS

[75] Inventor: John P. Goodworth, II, Medina, Ohio

[73] Assignee: Donn Incorporated, Westlake, Ohio

[21] Appl. No.: 803,729

[22] Filed: Dec. 2, 1985

Related U.S. Application Data

[63] Continuation-in-part of Ser. No. 713,275, Mar. 18, 1985, abandoned.

[51] Int. Cl.[4] ..... E04B 1/82

[52] U.S. Cl. ..... 52/145; 52/475; 52/781; 52/772

[58] Field of Search ..... 52/145, 484, 475, 780, 52/781, 772, DIG. 5, DIG. 1, 573

[56] References Cited

U.S. PATENT DOCUMENTS

| | | | |
|---|---|---|---|
| 1,997,607 | 4/1935 | Strom | 52/145 |
| 2,071,865 | 2/1937 | Parsons | 52/145 |
| 2,490,663 | 12/1949 | Van Vum | 52/460 |
| 2,734,126 | 2/1956 | Krager | 52/484 |
| 3,021,915 | 2/1962 | Kemp | 52/145 |
| 3,164,230 | 1/1965 | Adams | 189/85 |
| 3,277,622 | 10/1966 | Jensen | 52/222 |
| 3,581,453 | 6/1971 | Jones | 52/493 |
| 4,021,986 | 5/1977 | McCall et al. | 52/475 |
| 4,086,480 | 4/1978 | Lahm | 362/148 |
| 4,089,146 | 5/1978 | Martinez | 52/484 |
| 4,206,578 | 6/1980 | Mieyal | 52/730 |
| 4,344,267 | 8/1982 | Sukolics | 52/781 |
| 4,520,607 | 6/1985 | Suckow | 52/484 |

FOREIGN PATENT DOCUMENTS

| | | | |
|---|---|---|---|
| 2152662 | 4/1964 | Fed. Rep. of Germany | 52/510 |
| 2847007 | 4/1980 | Fed. Rep. of Germany | 52/145 |
| 1381143 | 10/1964 | France | 52/510 |
| 870849 | 6/1961 | United Kingdom | 52/484 |

*Primary Examiner*—Henry E. Raduazo

*Attorney, Agent, or Firm*—Pearne, Gordon, Sessions, McCoy, Granger & Tilberry

[57] ABSTRACT

A suspension ceiling system is disclosed which combines snap-up pans and lay-in panels. Such system includes runners formed with channels at the lower edges thereof formed by opposed lateral flanges, depending side walls, and inturned lips. The inturned lips terminate at inner edges which are spaced apart to provide a longitudinal opening on the lower side of the channel. Lay-in panels are positioned in some of the grid openings, and provide peripheral edges supported by the flanges. Snap-up panels formed of sheet metal are provided with peripheral flanges having inwardly directed ribs extending lengthwise of the flanges and spaced from the lower pan surface. The flanges are positioned in the openings beween the runner lips with the ribs snapped over the associated lip to secure the snap-up panels in position. The lips provide a delineation between the lay-in panels and the adjacent flanges of adjacent snap-up panels are spaced by substantially the same distance to provide a similar delineation. When sound absorption is required, a snap-up pan is installed in the same opening as a lay-in panel to define a chamber therebetween. Such snap-up pan is provided with apertures open to such chamber.

14 Claims, 8 Drawing Figures

SUSPENSION CEILING SYSTEM COMBINING SNAP-UP PANS AND LAY-IN PANELS

BACKGROUND OF THE INVENTION

This is a continuation-in-part of copending application Ser. No. 713,275, filed Mar. 18, 1985 (now abandoned).

This invention relates generally to suspension ceiling systems, and more particularly to a novel and improved system in which snap-up pans and lay-in panels are combined in a single system.

PRIOR ART

Suspension ceiling systems often include grid runners or tees which provide oppositely extending, panel-supporting flanges. In such systems, the peripheries of the panels extend over the flanges to support the panels. Such panels are installed by laying them in the panel openings, and therefore such panels are often referred to as "lay-in" panels. Examples of such systems are illustrated in U.S. Pat. Nos. 4,021,986; 4,086,480; and 4,206,578.

It is also known to provide suspension ceiling systems in which the grid members provide downwardly directed channels structured to grip the upstanding edges of metal pans. Such pan-type panels are usually installed by snapping the flanges up into the grid member channel, and are therefore generally referred to as "snap-up pans" or snap-up panels." Examples of such suspension systems with snap-up pans are illustrated in U.S. Pat. Nos. 2,734,446; 3,164,230; 3,277,622; and 3,581,453.

In systems such as the one illustrated in the 3,164,230 patent, supra, the pans provide a planar face which extends into contact with the planar face of adjacent pans. Consequently, the ceiling is completely filled. With such systems, the pans tend to oil-can or wrinkle when the building structure settles or sags. This is because there is no clearance between the pans, and any racking of the building results in a corresponding racking of the pans.

SUMMARY OF THE INVENTION

There are several aspects of this invention. In accordance with one aspect of the present invention, a novel and improved structure is provided permitting snap-up pans and lay-in panels to be installed within a single grid. Therefore, a single ceiling system combining both lay-in panels and snap-up pans is possible without requiring special mounting adapters and without requiring different types of runners for different grid portions.

In the illustrated embodiment, the pans are spaced a short distance from the adjacent pans. This provides pan delineation and also provides clearance so that pan racking or oil-canning does not occur if the grid is not completely plumb or does not continue to be perfectly plumb. Further, the illustrated embodiment provides the same type of delineation between the lay-in panels at locations where such panels are installed.

In accordance with another aspect of this invention, a combination is provided in which a snap-up pan and lay-in panel are mounted in the same grid opening. The two cooperate to define a chamber between the pans and panels and the snap-up pans are provided with a pattern of small openings communicating with the chamber. This structure provides good sound absorption.

These and other aspects of this invention are illustrated in the drawings, and are more fully described in the following specification.

DETAILED DESCRIPTION OF THE DRAWINGS

Figure 1:
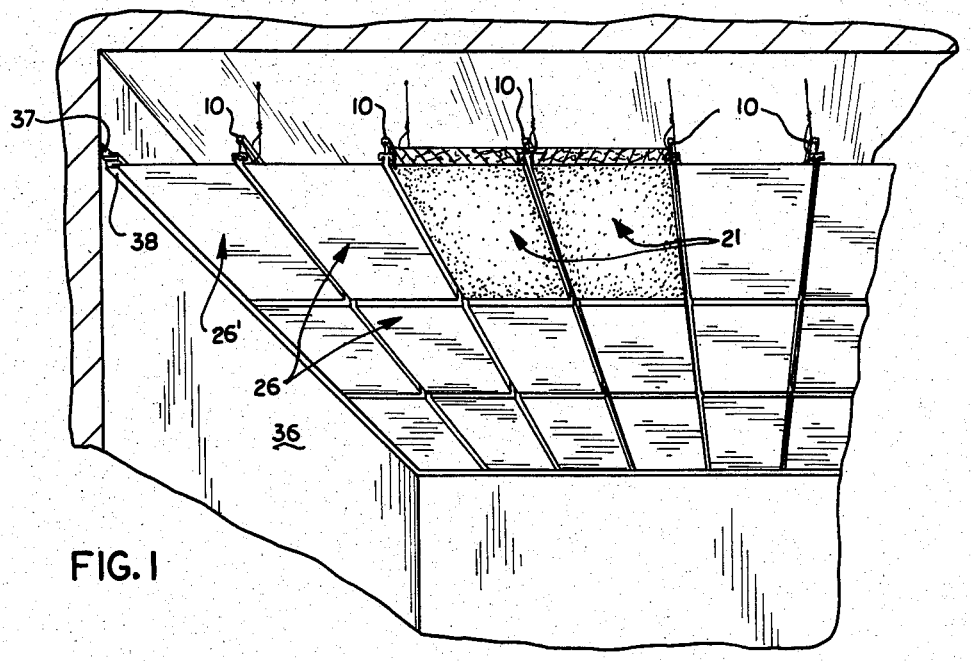
FIG. 1 is a fragmentary, perspective view of a ceiling structure in accordance with the present invention.

The grid tees or runners 10 are formed of a strip of metal bent to provide a longitudinally extending bulb 11 along the upper edge of the runner and a double layer web 12 extending from the lower edge of the bulb 11. The metal is formed along the lower edge of the web to provide oppositely extending flanges 13 and 14 which extend substantially perpendicular to the central plane of the runner to depending channel side walls 16 and 17, respectively. Such channel side walls are spaced on opposite sides of the web and are substantially parallel to each other. The side walls 16 and 17 extend downwardly to inturned lips 18 and 19, respectively. The lips are spaced apart a short distance, and are preferably formed with hemmed inner edges. The flanges 13 and 14 cooperate with the side walls 16 and 17 and lips 18 and 19 to define a boxlike channel section along the lower edge of the runners which is open lengthwise of the runners between the inner edges of the two lips 18 and 19.

Figure 3:
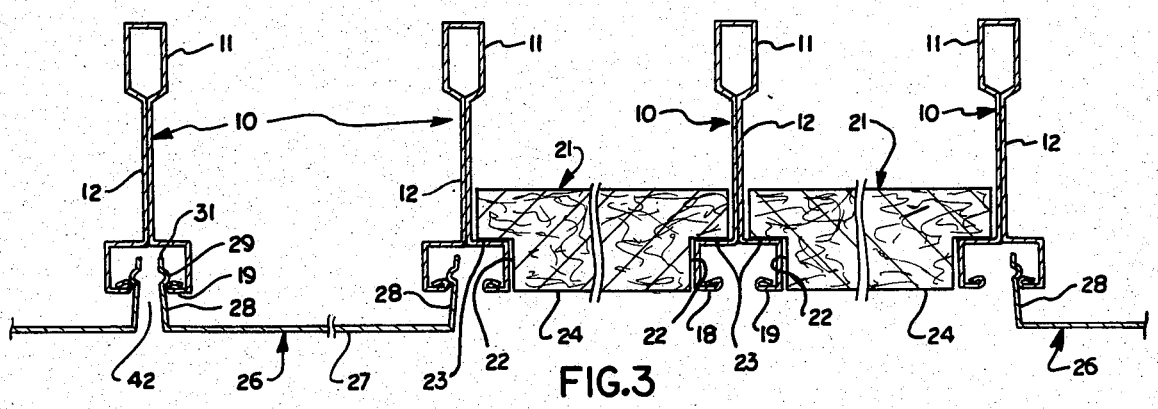
FIG. 3 is a fragmentary, vertical section illustrating a portion of the ceiling in which both lay-in panels and snap-up panels are provided within a single ceiling system.

This particular runner cross section is well known and is disclosed in U.S. Pat. No. 4,021,986. Such runners have been provided in grids in which lay-in panels are supported at their peripheries on the flanges 13 and 14 essentially as illustrated in FIG. 3, in which lay-in panels 21 are positioned between adjacent grid runners. Such panels are formed with peripheral rabbets or notches 22 to provide a radially extending shoulder 23. The shoulders 23 extend over the adjacent or associated flanges 13 and 14 to support the panels at their peripheries and, because the panels are notched out, the lower surfaces 24 of the panels are substantially coplanar with the associated lips 18 and 19.

Such grids, however, can be used in combination with standard lay-in panels 25 (illustrated in FIG. 7) which are not rabbeted. In such installations the lower surfaces of the panel extend to the panel edge and are supported on the flanges with the lower face of the panels coplanar with the flanges 13 and 14.

Figure 2:
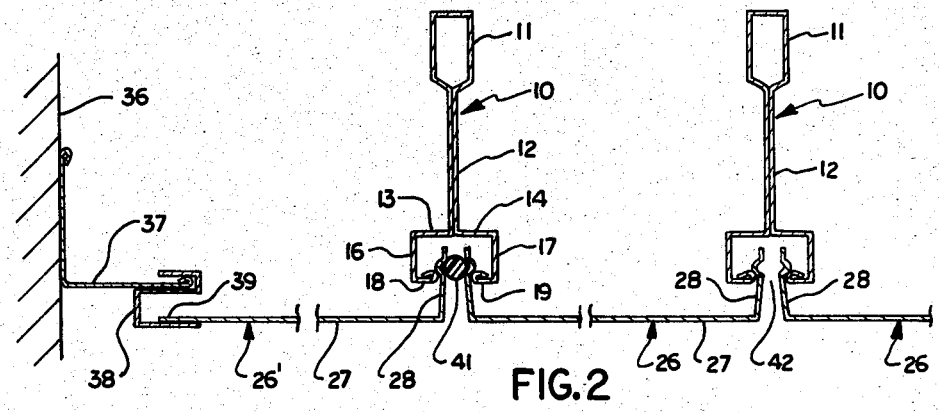
FIG. 2 is a fragmentary, vertical section illustrating the mounting of the snap-up panel, including such panels along the periphery of the ceiling.

The illustrated snap-up pans or panels 26 are normally formed of relatively thin sheet metal providing a planar ceiling surface 27 and upstanding flanges 28 around the edges of the planar surface 27. Such flanges are provided with a rib 29 substantially adjacent to the upper edges 31 of the flanges which is proportioned to snap over the adjacent of the lips 18 or 19 when the pans are snapped up into position as illustrated in FIGS. 2 and 3. The various elements are proportioned so that the flanges 28 are deflected outwardly a small amount from their unstressed condition when the pans are installed so as to provide a resilient force urging the ribs 29 over the associated lip 18 or 19 when the pans are snapped up into the mounting position. Such structure also prevents looseness and rattling of the pans.

In those portions of the ceiling in which the pans are spaced from the walls 36, the openings in which the snap-up pans are installed are completely surrounded by grid runs and the pans snap into their mounted position completely around the periphery thereof. However, at locations along the walls 36, the edges of the pans must normally be cut and mounted along some form of edge trim system. For example, as illustrated in FIG. 2, a small angle 37 is provided which is mounted along one leg thereof on the wall 36. The other leg extends laterally from the wall and, through an S-shaped clip 38, supports the cut edge 39 of the pan 26'. Because the flange 28 along one edge of the pan 26' has been cut away, such flange is not present to hold the rib 29 of the opposite flange against the associated lip 18. Therefore, a spline 41 is installed between the adjacent flanges of adjacent panels around the periphery of the ceiling to ensure that the peripheral pans 26' are retained in proper mounted position. The spline 41 may be made of plastic or an elastomer, and is shaped so that it can be pressed up into the gap between the ribs 29 of adjacent panels to provide a resilient force urging the adjacent pans apart. The ribs operate to properly position the spline for a uniform appearance. At other locations within the ceiling, such spline 41 is normally not required.

When the pans are installed, as illustrated in FIGS. 2 and 3, the adjacent flanges of adjacent pans are spaced apart a small distance 42. This provides delineation between the adjacent pans, which has a desirable aesthetic effect, but also ensures that sufficient clearance is provided between adjacent pans to allow for a certain amount of racking of the grid without causing oil-canning or corresponding racking of the pans.

Further, when lay-in panels are combined with snap-up pans, surface delineation is provided along both panel portions of the ceiling. As illustrated in FIG. 3, the two opposed lips 18 and 19 are spaced apart to provide a delineating opening between the lay-in panels 21. Similarly, the opening 42 between adjacent pans in provided along those portions of the ceiling.

Figure 7:
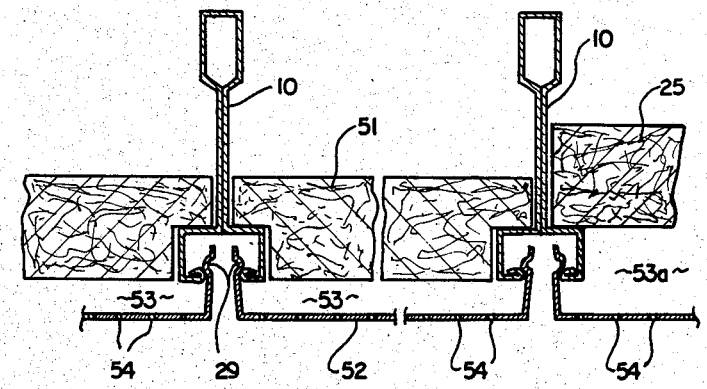
FIG. 7 is a fragmentary section illustrating lay-in panels and snap-up pans mounted in the same grid opening to provide sound absorption.

FIG. 7 illustrates an embodiment of this invention in which a lay-in panel 51 and a snap-up pan 52 are mounted within the same openings defined by the grid members 10. The panels 51 and the pans 52 cooperate to define a chamber 53 therebetween. The snap-up pans 52 are provided with a pattern of small perforations 54 which communicate with the chamber 53 and cooperate therewith to provide good sound absorption within the ceiling system. As illustrated in FIG. 7, the lay-in panels 51 may be of the same type as the lay-in panels 21 illustrated in FIG. 3 in that they are provided with rabbeted edges so that the lower face of the panel 51 is substantially flush with the lower face of the inturned lip 18 and 19. However, since the lay-in panels in such combined sound absorbing system are not exposed to view from below the ceiling, it is generally preferred to utilize a standard lay-in panel 25 of the type which is not rabbeted along its edges. Such panel provides a lower surface 56 which is coplanar with the supporting flanges 13 and 14. Such panels 25 are generally lower in cost than the rabbeted type panels illustrated at 51 and are preferred where the lay-in panels are hidden from view. Further, in such system, the chamber **53*a* has a greater depth than the chamber 53**.

Figure 4:
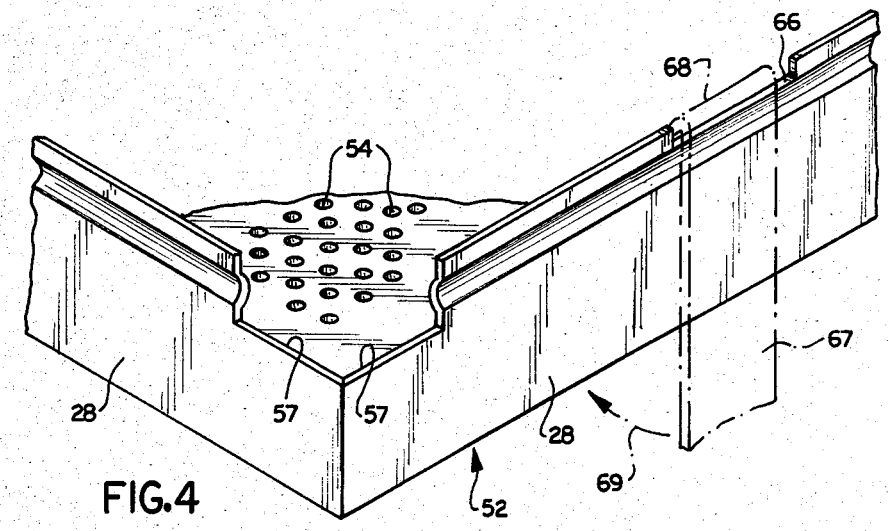
FIG. 4 is a fragmentary, perspective view illustrating the corner structure of the snap-up pan.

The pans 26 and 52 are preferably formed so that a notch 57 is provided in the upper edges of the flanges 28 at the panel corner, as illustrated in FIG. 4. Such notches 57 are sized to allow the installation of the snap-up pans in grid systems in which the lips are not mitered, as well as in grid systems in which the lips are mitered.

Figure 5:
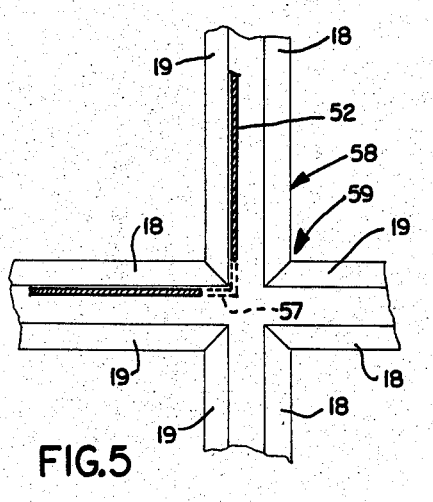
FIG. 5 is a fragmentary section illustrating the installation of the snap-up pan installed in a grid system in which the grid intersections are mitered.

FIG. 5 illustrates the installation of a snap-up pan 26 or 52 in a grid system 58 wherein the inwardly projecting lips 18 and 19 are mitered at the intersections 59 between the main runs and the cross runs. In such instance, the notches 57 are not required at the corners, since the flanges 28 can extend around the ends of the intersections between associated lips 18 and 19.

Figure 6:
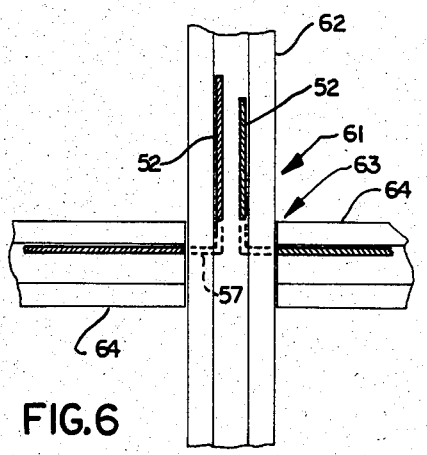
FIG. 6 is a fragmentary section similar to FIG. 5, but illustrating the installation of a snap-up pan installed in a grid in which intersections are not mitered and the cross-tees butt against the sides of the main tees.

The presence of the notches 57 does not detract from the use of a pan containing such notches in such a grid system. The presence of the notches 57, however, permits the use of the same pan in a grid system 61 in which the main runs 62 extend through the intersection 63 and the cross runs 64 merely butt against the sides of the main run as best illustrated in FIG. 6. In such instance, the lips 18 and 19 of the main run 62 extend in an unbroken manner through the intersection and would interfere with the flanges 28 at the corners if it were not for the notches 57.

The notches 57 are preferably only deep enough to allow the installation of the pans in an intersection of the type illustrated in FIG. 6, and the lower edges of the notches substantially abut the lower surface of the associated lips so that the gap is not noticeable.

When snap-up pans are used in a grid system in which the lips are not mitered, as illustrated in FIG. 5, but abut as illustrated in FIG. 6, an improved appearance is provided, since the pans project down below the lips and tend to obscure the fact that the lips 18 and 19 of the main runs extend in an uninterrupted manner through the intersections 63.

Figure 8:
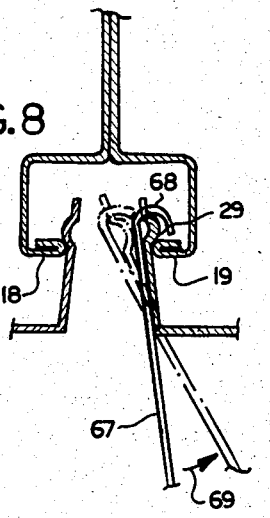
FIG. 8 is a fragmentary section illustrating a tool used to remove snap-up pans from grids.

As illustrated in FIG. 4, the flanges 28 are preferably formed with shallow notches 66 along their edges and at locations substantially adjacent to the respective corners of the pans. Such notches are provided so that a tool 67 can be inserted up between adjacent pans for the removal of selected pans from the system. Such tool is provided with a hooked portion 68 which fits into the notch 66 when the tool is in place as illustrated in FIGS. 4 and 8. Removal of the pan is accomplished by rotating the tool, as indicated by the arrow 69, to move the rib 29 out clear of the associated lips 18 and 19 so that the pan can drop down and be removed.

Generally, the removal procedure involves inserting the tool adjacent the one corner to release the rib at that location and then remove and reinsert the tool at the other end of the particular flange and repeat the operation along at least two adjacent sides of the pans.

With the present invention, considerable flexibility can be obtained within a suspension ceiling. For example, a single ceiling can be provided with exposed lay-in panels along selected portions of the ceiling and snap-up pans along other portions. Further, a ceiling can be provided in which some or all of the openings in a grid can be filled with both lay-in panels and snap-up pans to provide good sound absorption.

In accordance with the present invention, a single ceiling system is provided with both lay-in panels and snap-up pans. Consequently, more than one type of surface treatment may be provided within the single ceiling systems. Such variations in surface treatment may be provided within a single room, or adjacent rooms within a single ceiling grid. With this invention, therefore, a ceiling system is provided which gives the designer greater variation possibilities.

Although the preferred embodiment of this invention has been shown and described, it should be understood that various modifications and rearrangements of the parts may be resorted to without departing from the scope of the invention as disclosed and claimed herein.

What is claimed is:

1. A suspension ceiling comprising a grid formed of runners each providing a bulb, a central web depending from said bulb, a pair of flanges along the edge of said web remote from said bulb extending laterally in opposite directions therefrom, and a pair of inwardly extending laterally spaced lips on the side of said flanges remote from said web, said runners being interconnected in said grid and cooperating to define a plurality of openings, lay-in panels in some of said openings supported along the periphery thereof by associated flanges, and snap-up pans in some of said openings providing upstanding peripheral lock means extending past associated of said lips, said lock means supporting said pans from said associated lips, adjacent edges of adjacent pans being spaced from each other so that racking of said grid does not produce corresponding racking of said pans.

2. A suspension ceiling as set forth in claim 1, wherein said pans are formed of sheet metal providing opposed pairs of upstanding flanges with inwardly directed ribs, said ribs being positioned above the associated lips to provide said lock means.

3. A suspension ceiling as set forth in claim 2, wherein said flanges are joined at corners, and said ribs terminate at locations spaced from said corners by a distance at least as great as the width of said lips.

4. A suspension ceiling as set forth in claim 2, wherein at least some of said pans provide single flanges without opposed flanges of a pair, and a spline is positioned between said single flange and the adjacent flange to maintain said ribs in position.

5. A suspension ceiling as set forth in claim 4, wherein said ribs provide flange channels along the outer sides of said flanges, and said spline is resilient and is uniformly located in said flange channels between adjacent flanges to provide a uniform appearance from beneath said ceiling.

6. A suspension ceiling as set forth in claim 2, wherein said pans and lay-in panels provide exposed ceiling surfaces, and said ceiling surfaces of said pans are below said ceiling surfaces of said lay-in panels.

7. A suspension ceiling as set forth in claim 1, wherein said lips are spaced apart to provide a delineation between adjacent lay-in panels similar to the delineation provided by the spacing between said pans.

8. A suspension ceiling as set forth in claim 1, wherein at least some of said snap-up pans and said lay-in panels are positioned in the same openings and cooperate to define a chamber therebetween, said snap-up pans providing apertures therein open to the associated of said chambers and cooperating therewith to absorb sound.

9. A suspension ceiling comprising a grid formed of runners, each runner providing a bulb, a central web depending from said bulb, and a downwardly open channel along the side of said web remote from said bulb;

said channel being formed by a pair of laterally extending flanges extending in opposite directions from the edge of said web remote from said bulb;

a pair of laterally shaped substantially parallel channel side walls with one depending from the outer lateral edge of each of said flanges, and a pair of inturned lips extending inwardly from an associated channel side wall and terminated at laterally spaced inner lip edges to provide a longitudinally extending channel opening;

said runners being interconnected to define a plurality of rectangular openings surrounded by said flanges and lips;

lay-in panels in some of said openings supported along the peripheries thereof by said flanges and providing lay-in panel lower surfaces encircled by said channel side walls and said lips;

sheet metal snap-up pans in some of said openings, said snap-up pans providing a central exposed surface and upstanding peripheral flanges extending therefrom;

said flanges providing inward projections spaced above said pan surface, said flanges extending through associated channel openings to position said projections over associated lips to lock said pans in said grid;

said runners and flanges being sized so that said flanges are deflected from their unstressed condition by the associated lip to retain said projections in engagement with said associated lip, said lay-in panel providing lower surfaces located in a plane above the exposed surfaces of said snap-up panel.

10. A suspension ceiling as set forth in claim 9, wherein said upstanding peripheral flanges intersect at the corners and said inward projections terminate at ends spaced from said corners by a distance at least equal to the width of said inturned lip.

11. A suspension ceiling as set forth in claim 9, wherein said upstanding flanges are formed with notches along the upper edges thereof proportioned to receive a tool for removing said snap-up pans from said ceiling.

12. A suspension ceiling as set forth in claim 9, wherein said exposed surfaces of said lay-in panels are spaced apart by said lips and said lips are spaced apart to provide delineation therebetween, said exposed surfaces of said snap-up pans being spaced apart by a distance substantially equal to the spacing between adjacent inner lip edges.

13. A suspension ceiling as set forth in claim 9, wherein at least some of said lay-in panels and said snap-up pans are located in the same openings, and in cooperation with said grid define an enclosed chamber between associated lay-in panels and snap-up pans.

14. A suspension ceiling as set forth in claim 13, wherein said snap-up pans are formed with perforations therein and said lay-in panels are formed of a sound-absorbing material, said snap-up pans and associated lay-in panels cooperating to provide sound-absorption.

* * * * *